US006250969B1

(12) United States Patent
Cai

(10) Patent No.: US 6,250,969 B1
(45) Date of Patent: Jun. 26, 2001

(54) ELECTRICAL CONNECTOR WITH IMPROVED HOUSING STRUCTURE

(75) Inventor: She-Min Cai, Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/395,380

(22) Filed: Sep. 14, 1999

(30) Foreign Application Priority Data

Apr. 16, 1999 (TW) ..... 88205878

(51) Int. Cl.[7] ..... H01R 13/10
(52) U.S. Cl. ..... 439/682; 439/733.1; 439/252
(58) Field of Search ..... 439/682–685, 439/252, 58, 71, 733.1

(56) References Cited

U.S. PATENT DOCUMENTS 3,122,407 * 2/1964 Cowe ..... 439/733.1 X
4,620,757 * 11/1986 Thevenaz ..... 439/733.1
4,684,193 * 8/1987 Havel ..... 439/259
5,489,221 * 2/1996 Fujiura et al. ..... 439/733.1
5,885,113 * 3/1999 Bricaud ..... 439/733.1

* cited by examiner

*Primary Examiner*—Lincoln Donovan
*Assistant Examiner*—Son V. Nguyen
(74) *Attorney, Agent, or Firm*—Wei Te Chung

(57) ABSTRACT

An electrical connector comprises a dielectric housing and a number of contacts received in the housing. The housing defines three aligned apertures and a partition is provided between two proximate aperture. The housing defines four recesses equiangularly disposed in a periphery of each aperture and two selected recesses thereof are respectively recessed in two partitions beside the aperture. Therefor each contact is received in a corresponding aperture and abuts against parts of the periphery of the aperture that are not recessed therein while being spaced from the partition. Thus, stress exerted on the partitions is limited thereby preventing the partitions from being crushed by the contacts.

3 Claims, 3 Drawing Sheets

ELECTRICAL CONNECTOR WITH IMPROVED HOUSING STRUCTURE

BACKGROUND OF THE INVENTION

The present invention relates to an electrical connector having a dielectric housing and a plurality of contacts compactly retained in the housing without damaging the housing.

U.S. Pat. Nos. 4,133,593; 4,645,278 and 5,535,100 disclose connectors each having a dielectric housing and a plurality of contacts received in the housing. The housing defines a plurality of apertures each having a tubular periphery and provides a partition between proximate apertures. When received in a corresponding aperture, the contact abuts against the partition between the proximate apertures and exerts a stress on the partition because the partition is lack of a recess means for spacing the contact therefrom. The stress may crack the partition between proximate apertures and produces a crack in the partition, especially when the pitch between proximate contacts is very small. During soldering procedure, melted tin will flow into the crack and electrically connect proximate contacts resulting in a short circuit thereof. Hence, an improved electrical connector is required to overcome the disadvantages of the prior art.

BRIEF SUMMARY OF THE INVENTION

An object of the present invention is to provide a connector having a dielectric housing and a plurality of contacts compactly received in the housing without damaging the housing.

Accordingly, an electrical connector comprises a dielectric housing and a number of contacts received in the housing. The housing defines three aligned apertures and a partition is provided between two proximate aperture. The housing defines four recesses equiangularly disposed in a periphery of each aperture and two selected recesses thereof are respectively recessed in two partitions beside the aperture. Therefor each contact is received in a corresponding aperture and abuts against parts of the periphery of the aperture that are not recessed therein while being spaced from the partition. Thus, stress exerted on the partitions is limited thereby preventing the partitions from being crushed by the contacts.

Each part is offset a predetermined angle from a line connecting the centers of the apertures. Each part comprises an arcuate surface and a pair of opposite side faces having extensions passing through the center of the associated aperture and forming an angle therebetween. The contacts abut against corresponding arcuate surfaces of the parts thereby securely retaining the contacts in corresponding apertures. The housing also defines a countersunk at an entrance of each aperture for facilitating insertion of the contact into the correspond aperture.

Other objects, advantages and novel features of the invention will become more apparent from the following detailed description of the present embodiment when taken in conjunction with the accompanying drawings.

DETAILED DESCRIPTION OF THE INVENTION

Figure 1:
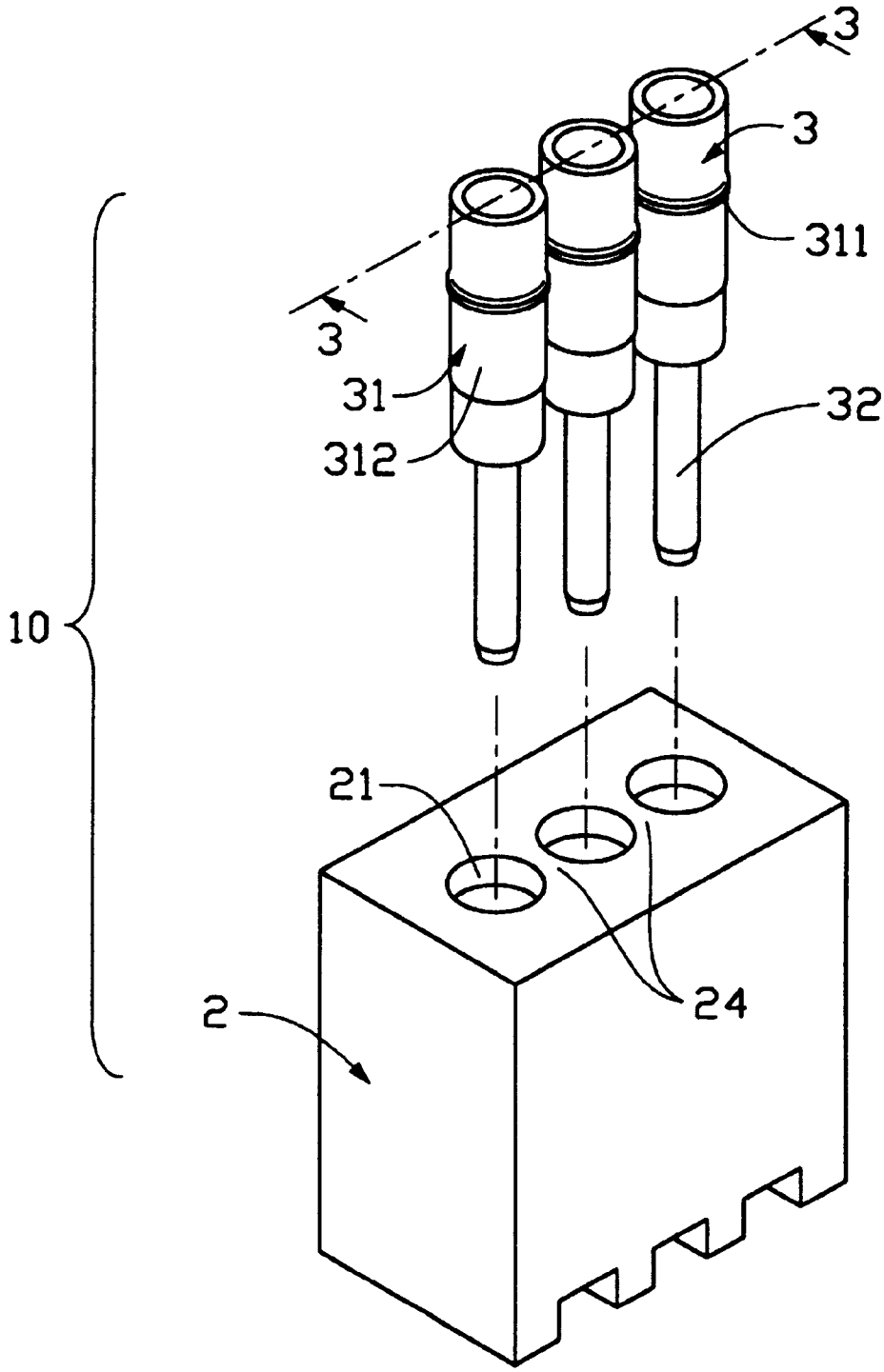
FIG. 1 is an exploded view of an electrical connector of the present invention.
Figure 2:
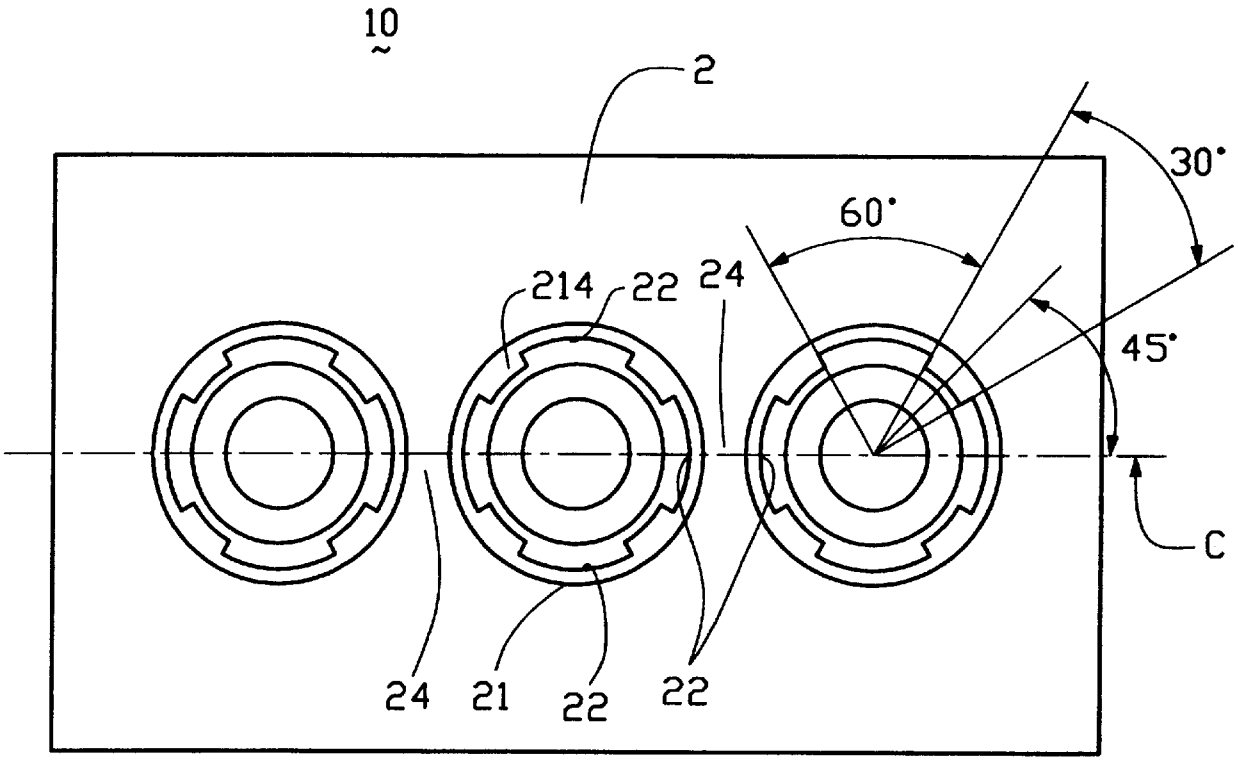
FIG. 2 is a top view of a dielectric housing of the electrical connector.
Figure 3:
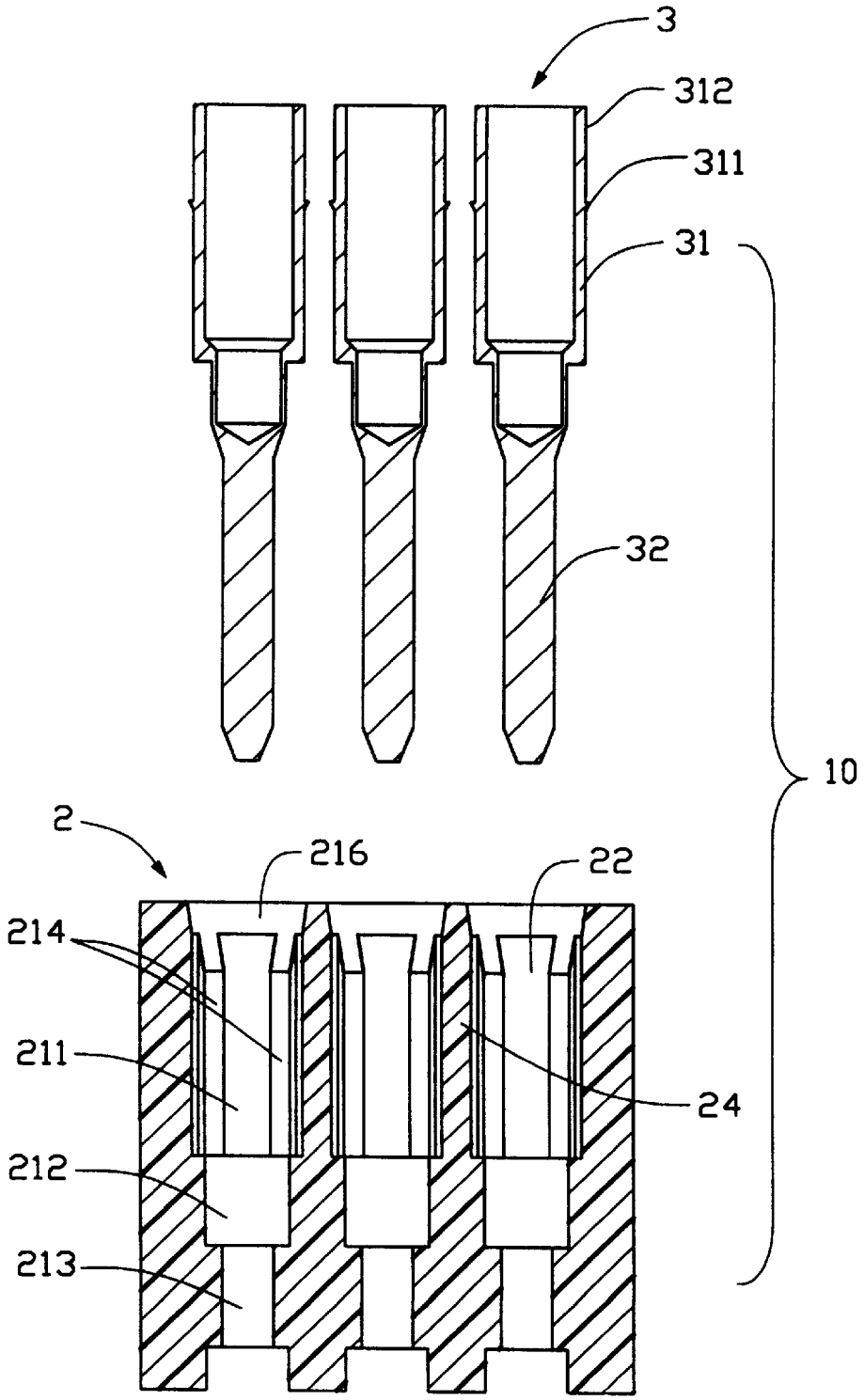
FIG. 3 is a cross-sectional view taken along line 3—3 of FIG. 1.

Referring to FIGS. 1, 2 and 3, an electrical connector 10 in accordance with the present invention comprises a dielectric housing 2 and three contacts 3 received in the housing 2. The housing 2 defines three aligned apertures 21 and a pair of partition 24 each formed between each pair of proximate apertures 21. Each aperture 21 comprises first, second and third portions 211, 212, 213 each having sequentially reduced diameters. The housing 2 defines four recesses 22 equiangularly disposed in a periphery of each aperture 21 and two selected recesses 22 thereof are respectively recessed in two partitions 24 beside the aperture 21. Each recess 22 angularly spans approximately 60 degrees. The housing 2 provides a part 214 that are not recessed therein between proximate recesses 22. Each part 214 angularly spans approximately 30 degrees. Each part 214 angularly spans 45 degrees from a central line "C" connecting centers (not labeled) of the apertures 21 to a center of the part 214. Furthermore, each part 214 has an arcuate surface (not labeled) facing the center of the aperture 21, and a pair of side faces (not labeled) having extensions passing through the center of the aperture 21. The housing 2 defines a countersunk 216 at an entrance of each aperture 21 for facilitating insertion of the contact 3 therein.

Each contact 3 is columnar and has mating and mounting portions 31, 32. The mating portion 31 forms a projecting ring 311 on an outer surface 312 thereof.

After the contacts 3 are assembled in the housing 2, the projecting ring 311 and the outer surface 312 of the mating portion 31 securely engage with the arcuate surfaces of the parts 214 and are spaced from the partitions 24. The contact 3 mainly exerts a stress on the parts 214 and the partition 24 between proximate apertures 21 is mildly affected and will not be damaged. Thus, a crack will not be produced in the partition 24 and a short circuit occurred in a conventional electrical connector will not happen in the electrical connector 10 in accordance with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric housing having a row of apertures aligned in a line and a plurality of partitions each formed between every adjacent two apertures, a pair of recesses disposed diametrically opposite each other along a direction in line with the row of apertures and at least one pair of projecting parts being formed on an inner surface of said aperture; and a plurality of contacts received in corresponding apertures of the housing, each contact being interference fitted with the at least one pair of projecting parts and being distanced from an associated partition by the pair of recesses, thereby preventing the partition from being crushed by the contact.

2. The electrical connector as claimed in claim 1, wherein four recesses are equiangularly disposed on a peripheral wall of each aperture of the housing.

3. The electrical connector as claimed in claim 2, wherein each recess angularly spans approximately 60 degrees.

* * * * *